US007372781B2

(12) United States Patent
Loth

(10) Patent No.: US 7,372,781 B2
(45) Date of Patent: May 13, 2008

(54) WATCH COMPRISING A SOLAR TIME DISPLAY

(75) Inventor: Eric A. Loth, Bienne (CH)

(73) Assignee: The British Masters SA, La Chaux-De-Fonds (CH)

( * ) Notice: Subject to any disclaimer, the term of this patent is extended or adjusted under 35 U.S.C. 154(b) by 19 days.

(21) Appl. No.: 10/506,922

(22) PCT Filed: Mar. 5, 2003

(86) PCT No.: PCT/CH03/00152

§ 371 (c)(1),
(2), (4) Date: Sep. 3, 2004

(87) PCT Pub. No.: WO03/077043

PCT Pub. Date: Sep. 18, 2003

(65) Prior Publication Data

US 2005/0207283 A1 Sep. 22, 2005

(30) Foreign Application Priority Data

Mar. 8, 2002 (EP) ..... 02405177

(51) Int. Cl.
*G04C 17/00* (2006.01)

(52) U.S. Cl. ..... 368/223; 368/232

(58) Field of Classification Search ..... 368/15–20, 368/28, 35–38, 223–225, 228, 232, 233, 368/238

See application file for complete search history.

(56) References Cited

U.S. PATENT DOCUMENTS

| | | | | |
|---|---|---|---|---|
| 1,459,710 A | | 6/1923 | Balch | 368/17 |
| 5,023,849 A | * | 6/1991 | Vaucher | 368/15 |
| 5,184,333 A | | 2/1993 | Caspar | 368/28 |
| 6,826,122 B2 | * | 11/2004 | Zaugg | 368/28 |

FOREIGN PATENT DOCUMENTS

EP 1286233 2/2003

* cited by examiner

*Primary Examiner*—Judy Nguyen
*Assistant Examiner*—Leo T Hinze
(74) *Attorney, Agent, or Firm*—Townsend M. Belser, Jr.; Nexsen Pruet, LLC

(57) ABSTRACT

A watch having a civil time display (12, 16), a solar time display (13, 18) and a mechanism for correction (24, 34, 36) of these displays. The correction mechanism is arranged in such a way as to allow the relative desynchronization of the civil time and solar time displays. A way of displaying this desynchronization (20, 22) is provided.

20 Claims, 5 Drawing Sheets

WATCH COMPRISING A SOLAR TIME DISPLAY

BACKGROUND OF THE INVENTION

1) Field of the Invention

The present invention pertains to watches comprising a solar time display. The management of time, on our planet, is nowadays based on a time reference, called GMT and on a structure of time zones within which the civil time is the same everywhere. Such a definition of time greatly simplifies human relationships. This time is, however, offset with respect to solar time, dependent on the longitude of a place, and which is displayed by sundials. The goal of the present invention is to propose a watch making it possible to ascertain both the civil time and the solar time, for any longitude and in any time zone.

To this end, the watch according to the invention comprises civil time display means, solar time display means and means of correction of the civil and solar time displays. According to the invention, the means of correction are arranged in such a way as to allow a relative manual desynchronization of the civil time and solar time display means. Moreover, this watch comprises means for displaying this desynchronization.

Hence, in order for the watch to actually display the solar time, it suffices that the civil time display means indicate the civil time of a time zone to be taken into account, and the means of display of the desynchronization the difference between the longitude of the middle of this time zone and the longitude of the place in question.

2) Description of Related Art

Admittedly, it is already known to display a desynchronization with reference to the mean solar time. Such a solution is described in U.S. Pat. No. 5,184,333. It pertains to a watch displaying the equation of time, that is to say the difference between the mean solar time and the true solar time. This desynchronization is performed automatically by means of a mechanism making one revolution in a year and driving a cam which controls the display. The information displayed is, in fact, valid only for the median position of a given time zone, everywhere else, the information displayed is erroneous, both for the true solar time and for the mean solar time.

Additionally, timepieces are known that allow an astronomical bearing to be taken, for example through U.S. Pat. No. 1,459,710, which describes a small clock that displays both the solar time and the sidereal time, thus allowing a bearing to be taken either at night or by day, to the extent that the sky is clear.

BRIEF SUMMARY OF THE INVENTION

Once the solar time is known, and if the sun is visible, it is easy to determine the direction of geographical north by means of such a watch, especially if the solar time display means comprise a solar time hand performing one revolution in twenty-four hours. Specifically, it is sufficient to aim the solar time hand at the sun. North is then located in the direction indicated on the dial by the index of the solar time midnight.

In a first embodiment of this watch the solar time display means comprise a solar time hand performing one revolution in twelve hours and a disk performing one revolution in twenty-four hours, driven in synchronism with the hand and carrying an index, indicating north, which hand and index are disposed in such a way that the hand and the index are superimposed when the hand displays midnight.

In a second embodiment,

- the civil time display means comprise an hour hand performing one revolution in twelve hours and a first dial, fixed, the upper part of which corresponds to the display of midday and midnight,
- the solar time display means comprise a hand performing one revolution in twenty-four hours, a second dial, fixed, indicating twenty-four hours over one revolution, the upper part of which corresponds to the display of midnight,
- the means of correction comprise a desynchronizer disposed between the civil time display means and the solar time display means and making it possible to desynchronize the solar time hand with reference to the hour hand, and
- said desynchronizer is furnished with display means, to indicate the desynchronization exhibited by the solar time hand with respect to the civil time hand.

In a third embodiment,

- the civil time display means comprise an hour hand performing one revolution in twelve hours and a first dial, fixed, the upper part of which corresponds to the display of midday and midnight,
- the solar time display means comprise a hand performing one revolution in twenty-four hours and a second dial, mobile in rotation, indicating twenty-four hours over one revolution, the upper part of which corresponds to the display of midnight,
- the means of correction are arranged to allow the rotation of the second dial with reference to the first dial, in such a way as to desynchronize their scales, and
- the first and the second dial comprise the one an index and the other a scale for indicating a difference of longitude, allowing adjustment of the desynchronization.

In the last two embodiments, it is advantageous for the second dial to carry a mark indicating north, disposed in such a way that the hand and the mark are superimposed when the hand displays midnight.

In order to facilitate aiming at the sun, the hand comprises an aiming member to allow its orientation toward the sun, comprising a body fixed to a runner of the watch, an index lying above the body, and a target, integral with the body and onto which the shadow of the index, caused by the sun, can be projected.

In the course of the year, a desynchronization appears between the mean solar time and the true solar time, known as the equation of time. The difference between the mean solar time and the true solar time is between around +15 and −15 minutes of time. Such a difference has a significant influence when one wishes to define the direction of north accurately. Hence, it is advantageous for the watch to furthermore comprise means of correction of the equation of time.

In order to be able to master this information, with the goal in particular of setting the watch if it stops, it is advantageous for the means of correction of the equation of time to comprise means of display of the position of the earth on the ecliptic.

BRIEF DESCRIPTION OF THE DRAWINGS

Other advantages and characteristics of the invention will emerge from the description which follows, given with regard to the appended drawing, in which.

DETAILED DESCRIPTION OF THE INVENTION

Figure 1:
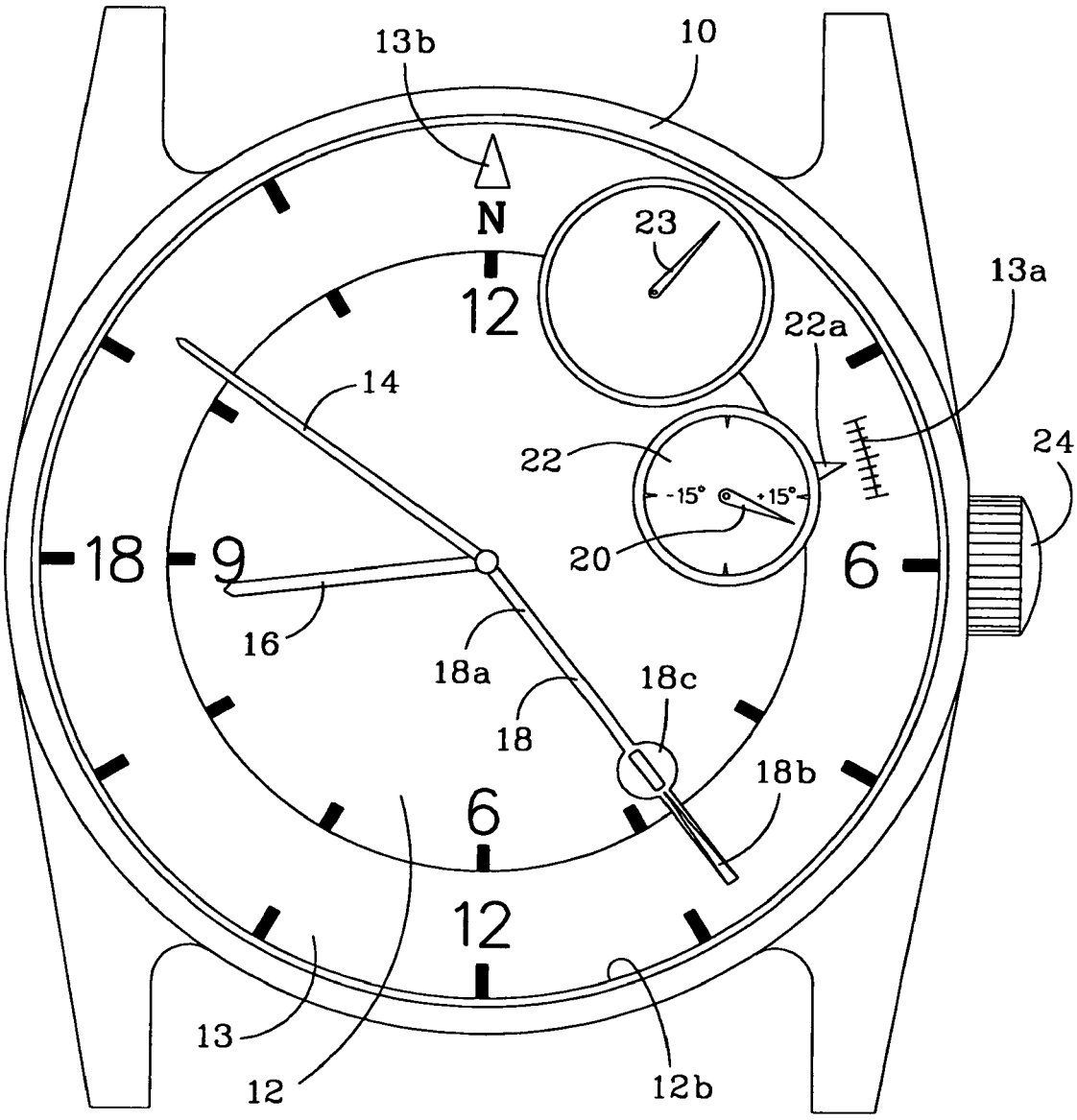
FIG. 1 represents a watch allowing display of the solar time and of geographical north.

FIG. 1 represents a watch according to a first embodiment of the invention. It comprises a case 10 in which is housed a movement which will be partially described with reference to FIG. 3 and which drives display means. The movement carries a central first dial 12 furnished with a twelve-hour scale, and an annular second dial 13 coplanar and concentric with the dial 12, and carrying a twenty-four hour scale. It moves a minute hand 14, a civil time hour hand 16 making one revolution in twelve hours, a solar time hand 18 making one revolution in twenty-four hours.

It furthermore comprises a longitude hand 20, disposed in front of a movable third dial 22 situated above the dials 12 and 13. A hand 23 ensures the displaying of the position of the Earth on the ecliptic, one revolution of the hand 23 corresponding substantially to a tropical year.

A time-setting crown 24 is disposed on the side of the case 10, to allow the correction of the information displayed by the watch, as will be explained later, and the winding up of a mainspring if the watch is a mechanical one.

Figure 2:
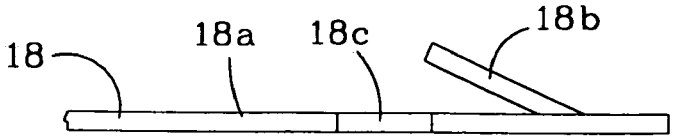
FIG. 2 illustrates, in a side view, a part of the watch of FIG. 1.

The hand 18 comprises, visible in FIGS. 1 and 2, a body 18*a*, a bent-back tip 18*b* and an aiming patch 18*c*, which is intended to facilitate the orientation of the piece so as to determine the direction of north. Aiming will be achieved by aligning the shadow of the tip 18*b* in the middle part of the patch 18*c*, which thus forms a target, which advantageously comprises a light line disposed between two dark sides. When the shadow and the light line coincide, the solar time hand 18 is then oriented toward the sun.

Figure 3:
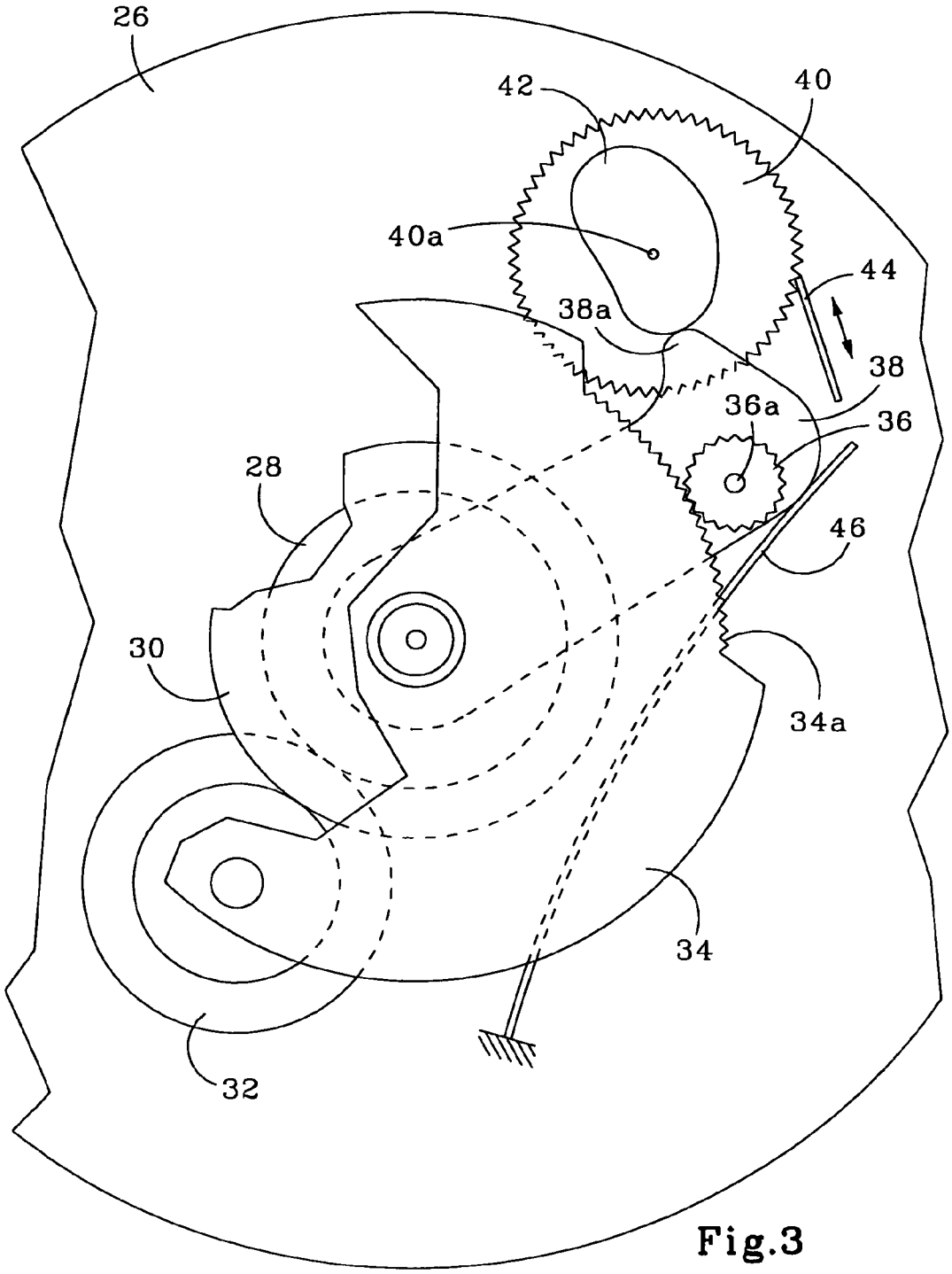
FIG. 3 shows, diagrammatically, a mechanism allowing this function, FIG. 4 pertains to a second embodiment of a watch allowing display of solar time and of geographical north, FIG. 5 pertains to a third embodiment of a watch allowing display of solar time and geographical north.

The mechanism carrying the hands 16, 18, 20 and 23 is represented in FIG. 3. It is disposed on a watch plate 26 serving as framework for the components of the watch, and in particular its time base and its finishing train, these not being visible since they are disposed on the hidden face of the plate 26.

The finishing train comprises, in a conventional manner, a minute wheel, carrying the hand 14 and meshing with a motion work wheel, which is linked to the time-setting mechanism and to an hour wheel 28, disposed at the center of the movement and intended to carry the hand 16.

A solar time wheel 30 is superimposed on the hour wheel 28. It is arranged to carry the hand 18. An intermediate wheel 32, mounted on a desynchronizer 34 links the wheel 30 to the wheel 28, gearing the movement down by a factor of 2.

The desynchronizer 34 is mounted pivotably at the center of the plate, on the pipe of the wheel 30. It is furnished with a toothed sector 34*a*, the function of which will be explained later.

To ensure correct display of the solar time in comparison to the civil time, two corrections have to be taken into account:

the longitude of the place where the person is located, and the equation of time.

These corrections are effected by a gear 36 meshing with the toothed sector 34*a* and mounted pivotably on a rocker 38. The gear is kinematically linked to the time-setting mechanism of the watch, for example through a runner, mounted pivotably on a rocker and that are not represented in the drawing so as to avoid overloading it, which is linked to the time-setting mechanism, which is controlled by the crown 24 when the latter is in one of its correction positions.

The gear 36 is furnished with a pivot 36*a* onto which the hand 20 is fixed. When the crown 24 is in the position in which the correction mechanism is kinematically linked to the gear 36, its rotation turns the gear 36, which drives the desynchronizer 34 and, with it, the intermediate wheel 32. The latter cooperates with the wheels 28 and 30 in the manner of a planet gear of a plane differential train.

As the wheel 28 is engaged with the finishing train, it cannot be otherwise moved, so that it is the wheel 30 that turns, and with it the hand 18.

Thus, by bringing the hand 20 opposite a point of the dial 22 corresponding to the difference between the longitudes of the place in question and of the middle of the reference time zone, the hand 18 is desynchronized with respect to the hour hand 16, in such a way that it displays the solar time of the place in question.

The gear 36 cooperates with a jumper spring (not represented in the drawing) and adjusted in such a way that it cannot turn under the effect of the torque generated by the wheel 28 on the wheel 32.

The correction of the equation of time is carried out by means of a wheel 40, performing one revolution in 365% days and carrying an equation-of-time cam 42, and furnished with a pivot 40*a* to which the hand 23 is keyed.

The wheel 40 advantageously comprises 487 teeth. It is driven in rotation by a pawl 44 performing a reciprocating movement and controlled by a cam carried by a wheel linked to the finishing train and performing one revolution in 18 hours. In the drawing, neither the cam nor the wheel are represented, their embodiment being obvious to the person skilled in the art.

The cam 42 cooperates with a finger 38*a* of the rocker 38. This finger 38*a* is held bearing against the cam 42 by a spring 46 fixed to the plate 26. Hence, the rocker 38 moves slowly, bearing against the cam 42, thus correcting the equation of time.

The dial 22 is fixed rigidly to the rocker 38, by means that are not represented, so that it follows the movement of this rocker. It comprises an index 22*a* making it possible to display the equation of time, with reference to a scale 13*a* of the dial 13.

The watch described therefore allows accurate displaying of the solar time, insofar as the longitude of the place is known, while taking account of and displaying the equation of time in a simple manner.

It also allows accurate determination of the direction of north. It suffices to orient the solar time hand 18 in the direction of the sun, by turning the watch in such a way that the index 18*b* casts a shadow at the center of the patch 18*c*. North is then located in the direction of the index 13*b* carried by the dial 13 into the position occupied by the hand 18 when it is midnight in solar time.

Figure 4:
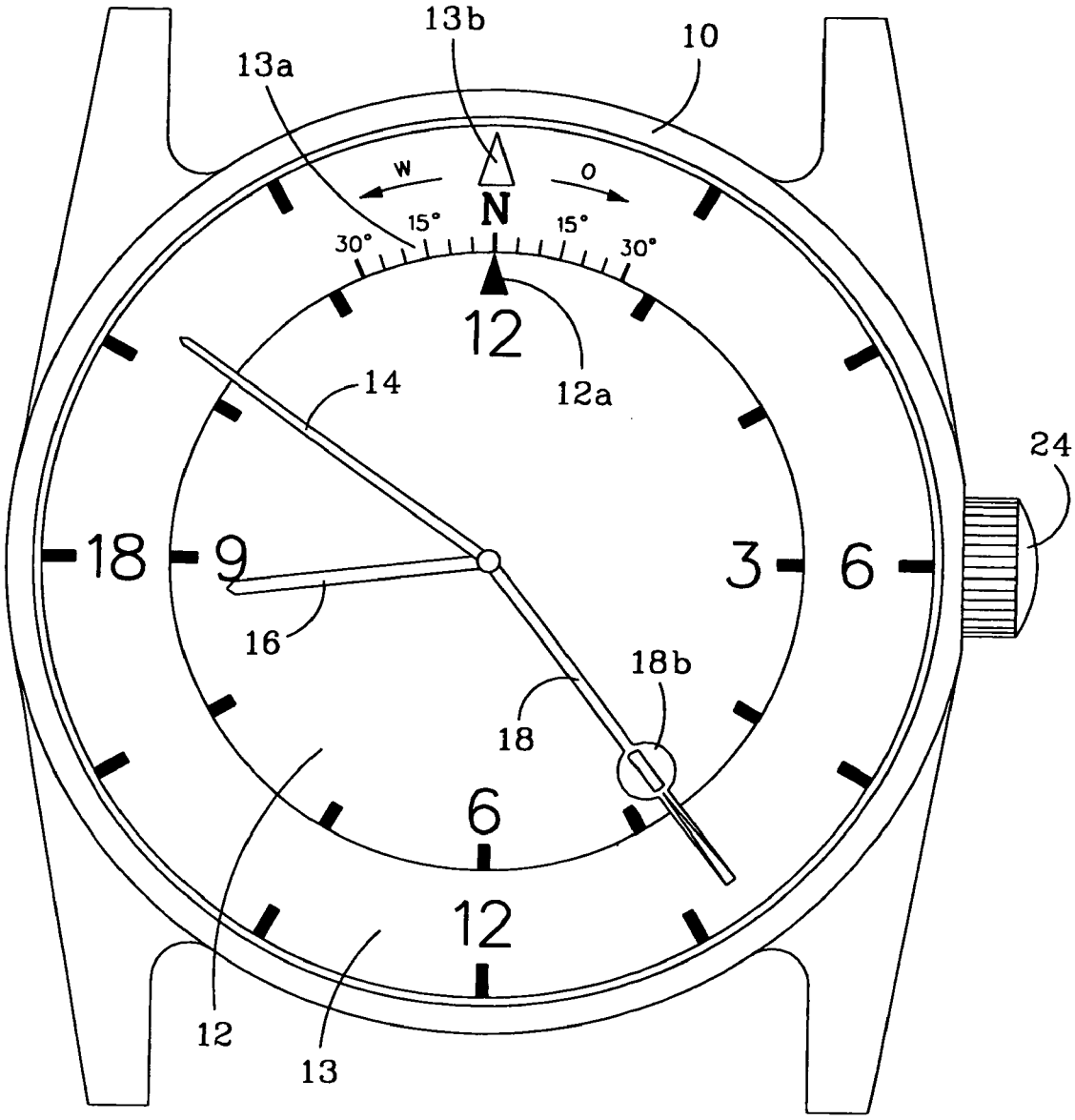

FIG. 4 represents a watch according to a second embodiment. Depicted therein is the case 10 in which is housed a movement that drives display means. The movement carries the first dial 12, furnished with a twelve-hour scale, the second dial 13 and the minute hand 14, the civil time hour hand 16 which makes one revolution in twelve hours, and the solar time hand 18 which makes one revolution in twenty-four hours.

In this watch, the dial 13 is arranged in such a way as to be able to turn with reference to the dial 12 and to be moved angularly by the time-setting crown 24. Driving by the crown 24 can, for example, be effected in the first position drawn, by means of a mechanism well known to the person skilled in the art.

The dial 12 carries an index 12*a* in the position through which the hour hand 16 passes at midnight and at midday, whereas the dial 13 carries a scale 13*a* opposite the index 12*a*, as well as an arrow 13*b* disposed in such a way that it is superimposed on the hand 18 when it is midnight in solar time, indicating north when the hand 18 is oriented toward the sun.

As a variant, the dial 13 could be replaced by a revolving ring mounted on the case 10 around the glass. In this circumstance, the bezel can be tuned directly, without involving the crown and the correction mechanism.

The scale 13*a* allows the position of the dial 13 to be adjusted as a function of the longitude of the place in question, by orienting it in such a way that the value located opposite the index 12*a* is equal to the offset in longitude between the place in question and the middle of the time zone.

This watch takes account only of the offset due to longitude. It is also possible to supplement it with a mechanism similar to that described with reference to FIG. 3, together with a correction of the equation of time. In this circumstance, however, the wheel 32 is fixed and the pinion 36 meshes with a toothing of the dial 13, which would then be moved by rotation of the crown 14, and by the movement of the rocker 38 bearing against the cam 40.

Figure 5:
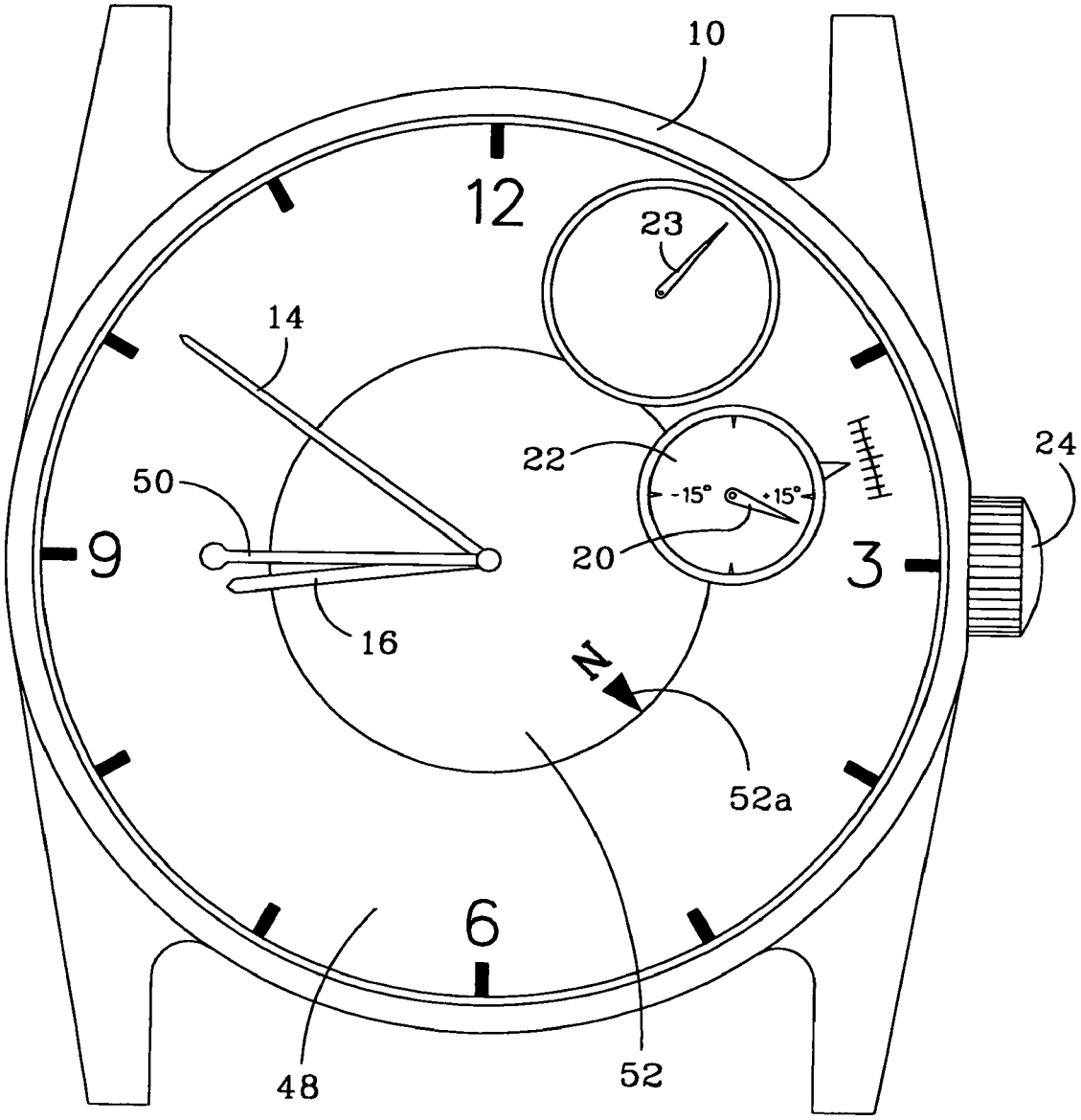

The watch represented in FIG. 5 corresponds to a third embodiment. It is furnished with a movement disposed in a case 10 and which will be described with reference to FIG. 6. Like the two embodiments described above, this watch is equipped with the minute hand 14 and civil time hour hand 16, the hand 20 and the longitude dial 22, the ecliptic hand 23, as well as the timesetting crown 24.

In this watch, the civil time is read on an annular dial 48 furnished with a twelve-hour scale, which serves as reference for the hands 14 and 16. The solar time display is carried out by means of a hand 50, performing one revolution in twelve hours, and of a central disk 52, driven in synchronism with the hand 50 and performing one revolution in twenty-four hours.

The disk 52 carries an index 52*a*, which indicates north when the solar time hand 50 is aimed at the sun. The hand 50 can, furthermore, be furnished with an aiming member such as defined with reference to FIGS. 1 and 2. It has, however, not been represented in FIG. 5.

Figure 6:
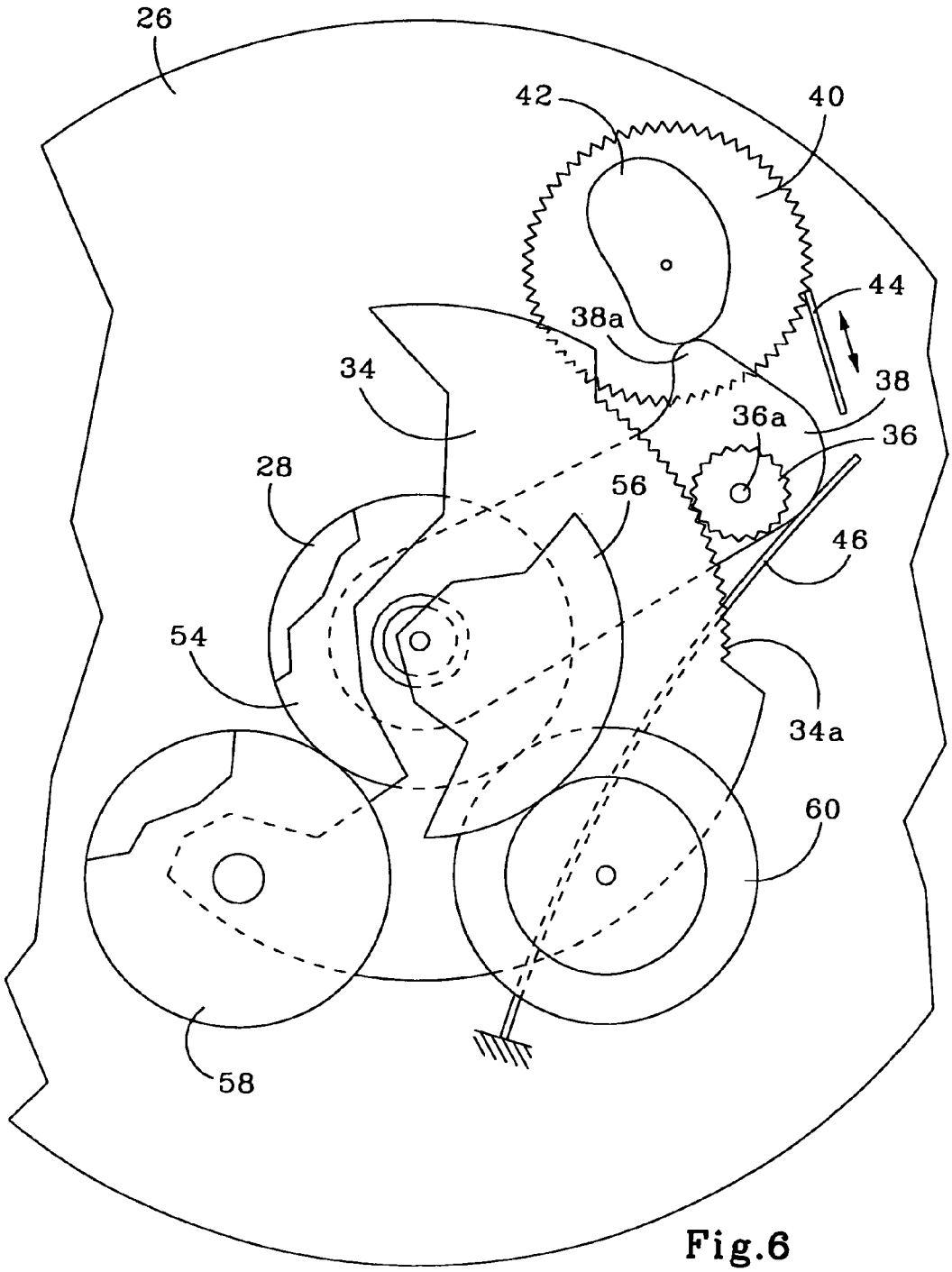
FIG. 6 shows diagrammatically a mechanism allowing the function of FIG. 5.

The watch of FIG. 5 is intended to be equipped with the movement represented in FIG. 6. Found therein is the plate 26, the hour wheel 28 intended to carry the hour hand 16, the desynchronizer 34, the gear 36, the rocker 38 and the wheel 40 carrying the equation-of-time earn 42 and driven by the pawl 44. The rocker 38 is likewise held bearing against the earn 42 by the spring 46.

This movement furthermore comprises a first central solar wheel 54, superimposed on the wheel 28 and of the same diameter, a second solar wheel 56, coaxial with the wheels 28 and 54. A planet gear 58, meshing both with the wheel 28 and the wheel 54, is mounted pivotably on the desynchronizer 34, which carries, furthermore, a runner 60, which is driven by the wheel 54 and entrains the wheel 56. The setting of the desynchronization between the solar time and the civil time is done in an identical manner to what was described with reference to FIGS. 1 and 3 as well as the correction of the equation of time. The solar wheels 56 and 58 are intended to carry the hand 50 and the disk 52 respectively.

Since the wheels 28 and 54 have the same diameter, and since they are kinematically linked by the planet gear 58, they turn in the same direction and at the same speed while the desynchronizer 34 is fixed.

The runner 60 and the wheel 56 comprise numbers of teeth chosen in such a way that the wheel 56 turns twice as slowly as the wheel 54, that is to say it makes one revolution in twenty-four hours.

In this embodiment, the solar time display is effected on the twelve-hour scale, which is more customary—and hence easier to read—than the twenty-four hour scale.

The three embodiments described above make it possible to determine the direction of north at a given place, insofar as the longitude of this place is known, by orienting the hand 18 or 50 in the direction of the Sun. It is also possible to determine the longitude of the place in question by noting, at night and on a fixed surface, the direction of the pole star, which corresponds to geographical north. On the next day the watch is oriented in such a way that the index indicating north coincides with the noted direction. Thereafter it suffices to correct the longitude indicator until the hand 18 is aimed at the Sun.

The watches thus described therefore make it possible, through simple and easily manipulated technical means, to display both the civil time and the solar time, and to determine the direction of geographical north or else the longitude of the place in question. These watches may, of course, form the subject of numerous other variants, without thereby departing from the scope of the invention. They may thus comprise or otherwise a correction relating to the equation of time. The mechanisms intended for ensuring the desynchronization between the solar time and the civil time, as a function of longitude and of the equation of time may, naturally, exhibit very different structures and shapes. Thus, the wheel 40 could also be associated with a conventional calendar mechanism, displaying the day and the month, the equation-of-time cam being controlled by the runner carrying the month indicator.

The above description pertains to a watch of mechanical type. It is also possible to envisage solutions calling upon a display by means other than hands, for example liquid crystal display cells. In this circumstance, the time base will be a quartz crystal. In order for this timepiece to also be able to determine the direction of geographical north, at least the solar time will be displayed by means of a hand simulated by indices disposed radially on the display cell.

What is claimed is:

1. A watch comprising civil time display means, solar time display means and means of correction of said displays, wherein said means of correction is arranged in such a way as to allow a relative manual desynchronization of the civil time and solar time display means, and wherein said means of correction comprises means for displaying said desynchronization.

2. The watch as claimed in claim 1, wherein the solar time display means comprises a solar time hand performing one revolution in twenty-four hours.

3. The watch as claimed in claim 2, wherein:

the civil time display means comprises an hour hand performing one revolution in twelve hours and a first dial, fixed, the upper part of which corresponds to the display of midday and midnight, the solar time display means comprises a second dial, fixed, indicating twenty-four hours over one revolution, the upper part of which corresponds to the display of midnight, the means of correction comprises a desynchronizer disposed between the civil time display means and the solar time display means and making it possible to desynchronize the solar time hand with reference to the hour hand, and said desynchronizer is furnished with display means to indicate the desynchronization exhibited by the solar time hand with respect to the civil time hand.

4. The watch as claimed in claim 3, wherein the second dial carries an index disposed in such a way that it is superimposed on said hand when the latter displays midnight, so that said index shows geographical north when said hand is aimed at the sun.

5. The watch as claimed in claim 4, wherein the solar time hand comprises an aiming member to allow its orientation toward the sun, said aiming member comprising a body fixed to a runner of the watch, an index lying above the body and a target, integral with the body and onto which the shadow of the index can be projected.

6. The watch as claimed in claim 4, further comprising means of correction of the equation of time.

7. The watch as claimed in claim 3, wherein the solar time hand comprises an aiming member to allow its orientation toward the sun, said aiming member comprising a body fixed to a runner of the watch, an index lying above the body, and a target, integral with the body and onto which the shadow of the index can be projected.

8. The watch as claimed in claim 3, further comprising means of correction of the equation of time.

9. The watch as claimed in claim 2, wherein the solar time hand comprises an aiming member to allow its orientation toward the sun, said aiming member comprising a body fixed to a runner of the watch, an index lying above the body, and a target, integral with the body and onto which the shadow of the index can be projected.

10. The watch as claimed in claim 9, further comprising means of correction of the equation of time.

11. The watch as claimed in claim 2, further comprising means of correction of the equation of time.

12. The watch as claimed in claim 1, wherein it comprises, furthermore, means of correction of the equation of time.

13. The watch as claimed in claim 12, wherein the means of correction of the equation of time comprises means of display of the position of the earth on the ecliptic.

14. The watch as claimed in claim 1, wherein the solar time display means comprises a solar time hand performing one revolution in twelve hours and a disk performing one revolution in twenty-four hours, driven in synchronism with said hand and carrying an index indicating north, which hand is disposed in such a way that the hand and the index are superimposed when the hand displays midnight.

15. The watch as claimed in claim 14, wherein the solar time hand comprises an aiming member to allow its orientation toward the sun, said aiming member comprising a body fixed to a runner of the watch, an index lying above the body, and a target, integral with the body and onto which the shadow of the index can be projected.

16. The watch as claimed in claim 14, further comprising means of correction of the equation of time.

17. A watch comprising civil time display means, solar time display means and means of correction of said display means, wherein said means of correction is arranged in such a way as to allow a relative manual desynchronization of the civil time and solar time display means, wherein said means of correction comprises means for displaying said desynchronization, wherein the solar time display means comprises a solar time hand performing one revolution in twenty-four hours, and wherein:

the civil time display means comprises an hour hand performing one revolution in twelve hours and a first dial, fixed, the upper part of which corresponds to the display of midday and midnight, the solar time display means comprises a second dial, mobile in rotation, indicating twenty-four hours over one revolution, the upper part of which corresponds to the display of midnight, the means of correction is arranged to allow the rotation of the second dial with reference to the first dial, in such a way as to desynchronize their scales, and the first dial and the second dial comprise the one an index and the other a scale to allow the adjustment of the desynchronization.

18. The watch as claimed in claim 17, wherein the second dial carries an index, disposed in such a way that it is superimposed on said hand when the latter displays midnight, so that said index shows geographical north when said hand is aimed at the sun.

19. The watch as claimed in claim 17, wherein the solar time hand comprises an aiming member to allow its orientation toward the sun, said aiming member comprising a body fixed to a runner of the watch, an index lying above the body, and a target, integral with the body and onto which the shadow of the index can be projected.

20. The watch as claimed in claim 17, further comprising means of correction of the equation of time.

* * * * *